US008811854B2

(12) United States Patent
Nose

(10) Patent No.: US 8,811,854 B2
(45) Date of Patent: Aug. 19, 2014

(54) DEVELOPING APPARATUS HAVING A MAGNETIC SEAL

(75) Inventor: Katsuya Nose, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 153 days.

(21) Appl. No.: 13/275,442

(22) Filed: Oct. 18, 2011

(65) Prior Publication Data

US 2013/0051842 A1 Feb. 28, 2013

(30) Foreign Application Priority Data

Aug. 30, 2011 (JP) ..... 2011-187326

(51) Int. Cl.
*G03G 15/09* (2006.01)

(52) U.S. Cl.
CPC ..... *G03G 15/09* (2013.01)
USPC ..... 399/104; 399/267

(58) Field of Classification Search
CPC ..... G03G 15/0942; G03G 15/0921; G03G 15/09; G03G 15/0817; G03G 2215/0609
USPC ..... 399/104, 103, 267, 269
See application file for complete search history.

(56) References Cited

U.S. PATENT DOCUMENTS

| | | | | |
|---|---|---|---|---|
| 4,498,246 | A | 2/1985 | Cantu et al. | |
| 5,177,536 | A * | 1/1993 | Watanabe et al. | 399/222 |
| 7,263,318 | B2 | 8/2007 | Nishihama et al. | |
| 7,277,649 | B2 | 10/2007 | Hirobe et al. | |
| 7,349,653 | B2 | 3/2008 | Nishihama et al. | |
| 7,362,989 | B2 | 4/2008 | Nishihama et al. | |
| 7,386,261 | B2 | 6/2008 | Noguchi et al. | |
| 7,421,226 | B2 | 9/2008 | Suenami et al. | |
| 7,630,670 | B2 | 12/2009 | Nishihama et al. | |
| 7,664,435 | B2 | 2/2010 | Nose | |
| 7,881,638 | B2 | 2/2011 | Noguchi et al. | |
| 2006/0257162 | A1 | 11/2006 | Suenami et al. | |
| 2009/0285607 | A1 * | 11/2009 | Sakamaki et al. | 399/267 |
| 2011/0052220 | A1 | 3/2011 | Nose | |

FOREIGN PATENT DOCUMENTS

| | | | |
|---|---|---|---|
| JP | 9-319223 | A | 12/1997 |
| JP | 10-31363 | A | 2/1998 |
| JP | 11-52731 | A | 2/1999 |
| JP | 2003-57929 | A | 2/2003 |
| JP | 2004-191469 | A | 7/2004 |
| JP | 2006-317564 | A | 11/2006 |
| JP | 2007-304141 | A | 11/2007 |
| JP | 2008-116723 | A | 5/2008 |
| JP | 2009-151103 | A | 7/2009 |

* cited by examiner

*Primary Examiner* — Sophia S Chen
(74) *Attorney, Agent, or Firm* — Fitzpatrick, Cella, Harper & Scinto

(57) ABSTRACT

A developing apparatus includes a developing container for accommodating developer including magnetic particles, a developer carrying member, rotatably provided in the developing container, for carrying the developer to a region where the developer carrying member is opposed to image bearing member, and a magnet stationarily provided in the developer carrying member, having a pair of magnetic poles of the same polarity adjacent to each other in a circumferential direction of the developer carrying member. In addition, a magnet member extends at each of longitudinal end portions of the developer carrying member within a circumferential range opposed to and between a half-peak width zone of one of the magnetic poles and a half-peak width zone of the other one of the magnetic poles. A side of the magnet member opposed to the developer carrying member is magnetized only to a polarity which is the same as the polarity of the pair of magnetic poles.

4 Claims, 14 Drawing Sheets

DEVELOPING APPARATUS HAVING A MAGNETIC SEAL

FIELD OF THE INVENTION AND RELATED ART

The present invention relates to a developing apparatus for developing an electrostatic latent image formed on an image bearing member into a toner image in an electrophotographic copying machine, a laser beam printer or the like.

As for such a developing apparatus usable with the image forming apparatus of a electrophotographic copying machine, a powder cloud method, a cascade method, a magnetic brush method or the like is known. With a magnetic brush method for a two component developing system, a two component developer containing a magnetic carrier and toner or the like in mixture is attracted by magnetic field generating means and is formed into an erected chain brush by a magnetic pole portion. The developer brush rubs an electrostatic latent image formed on a photosensitive drum to develop the electrostatic latent image. At this time, a magnetic carrier in the developer functions as soft developing electrodes, and therefore, the toner can be deposited in proportion to charge densities of the electrostatic latent image, that is, this method is suitable for reproduction of a tone gradation image In addition, the developing apparatus per se can be compact.

A magnetic brush developing device using the two component developing system ordinarily uses an developing sleeve as a developer carrying member. In order to develop the electrostatic latent image on the photosensitive drum, the magnetic carrier of magnetic particles of ferrite, for example, and toner comprising resin material and pigment dispersed therein are mixed and stirred into a two component developer. The toner is charged electrically by triboelectric charge by the friction among them. The developer is carried on a developing sleeve which is a hollow cylindrical developer carrying member of a non-magnetic member, the developing sleeve having a magnetic pole therein. The developing sleeve carries, from a developer container, the developer to a developing zone where the developing sleeve is opposed to the photosensitive drum. In the developing zone, the developer powder is erected by the function of the magnetic field to rub the surface of the photosensitive drum, thus developing the electrostatic latent image formed on the photosensitive drum. The two component magnetic brush developing method using the developing sleeve is widely used particularly in a monochromatic digital copying machine or a full-color copying machine which requires a high image quality.

The two component magnetic brush developing type developing apparatus using the developing sleeve comprises following elements. They are a developing container for accommodating the two component developer, a stirring and feeding member such as a screw configuration member for stirring and feeding a developer within a developing container, and a developing sleeve containing magnetic field generating means as a developer carrying member. Normally, the developing sleeve is rotatably provided in an opening of the developing container and is opposed to the photosensitive drum as an image bearing member. In such a normal developing apparatus, a developer may leak through a gap between the developing sleeve and the developing container at a longitudinal end portion.

In order to prevent the developer leakage at the end portion of the developing apparatus, it has been proposed that an elastic sealing member is mounted to each of the opposite ends of the developing sleeve, thus preventing the leakage. However, with such a sealing structure, the elastic sealing member is press-contacted to the outer surface of the developing sleeve, and therefore, the load to the developing sleeve is large, and the sealing property lowers due to the deterioration of the elastic sealing member.

In a developing apparatus using toner or carrier particles magnetically attractable, it would be considered that the use is made with magnetic force generating means to effect magnetic seal. For example, a magnetic sealing member is opposed to a surface of the developing sleeve with a predetermined space, and the surface of the magnetic sealing member is magnetized to magnetically attract the developer. With such a magnetic seal structure, the developing sleeve and the magnetic sealing member are not contacted with each other, and therefore, the rotational load of the developing sleeve is small, and the deterioration attributable to the wearing or the like does not occur, so that the service life is long.

More particularly, a plate-like end magnet as the magnetic sealing member is mounted so as to surround the developing sleeve in the circumferential direction, by which magnetic chains of the developer are formed between the end magnet and the magnet roller which is a magnetic field generating means provided in the developing sleeve, thus preventing the leakage. In this case, when one surface as the end magnet plate is magnetized to N pole, and the back side is magnetized to S pole, it is desirable that the surface having the polarity opposite the polarity of the magnet roller inside the developing sleeve is faced to the developing sleeve. This is because then the magnetic force lines extend from the end magnet (magnetic sealing member) toward the magnet roller in the developing sleeve, so that the magnetic chains of the developer are formed between the developing sleeve and the end magnet. The magnetic chains function to prevent the developer from leaking to the end, thus further suppressing the developer leakage. Particularly, in a region in which a repelling pole of magnet roller in the developing sleeve is formed, the intensity of the magnetic field is low between the poles, and therefore, it is necessary to improve the sealing property by opposing a different polarity pole.

It has also been proposed that an inner surface of a magnetic sealing member has many NS poles. With such a structure, the magnetic force lines extend among the magnetic poles of the sealing member, and therefore, the magnetic force lines do not tend to extend outwardly in the longitudinal direction of the developing sleeve, thus enhancing the sealing property against the developer leakage.

In the conventional methods in which the end magnet has the different polarity pole opposed, the magnetic force lines extend between the different poles, and the magnetic chains are formed by the developer confined by the magnetic force lines. The developer of the magnetic chains is confined by strong magnetic forces, and therefore, even when the developer circulates in the developing container enters it, no exchange of the developer occurs, and the developer is retained. For this reason, the developer confined between the developing sleeve and the end magnet and the developer fed to the end of the developing sleeve are rubbed with each other. In order to meet the demand for high speed, the recent copying machine is such that the rotational speed of the photosensitive drum is high, and the rotational speed of the developing sleeve is also high to provide sufficient development efficiency, thus matching the high speed photosensitive drum. Because of such increase in rotational speed of the developing sleeve, the above-described sliding in a developing apparatus end increases between a developing sleeve and end magnet. Such sliding between the developer confined between the end magnet and the developing sleeve and a developer fed to the end of the developing sleeve are rubbed relative to each other tend to peel in a shear plane. As a result, with the use of the developing apparatus, the toner leakage may occur at the end, with the result that the inside of the copying machine is contaminated, or masses of the developer drop on an end portion of the resultant image.

In consideration of the above, it would be considered that a magnet of the same pole as the magnetic pole of the magnet roller is disposed opposed to form a repelling magnetic field between them, by which a fluid layer carried on the developing sleeve and the stationary layer carried on the magnet are separated, so that the toner separation in the shear plane is suppressed. However, along the circumferential direction of the magnet roller, S pole and the N pole are alternately arranged, and therefore, even if the magnet opposed to the roller has the same polarity, in the zones before and after the same polarity pole, there are different polarity pole magnets. Since it is required that the magnetic force of the magnet is strong to form a strong magnetic field enough to extend the magnetic chain to the surface of the sleeve, and therefore, the magnetic force line is strong at the position where the polarity changes, which may result in formation of a shear plane.

Under the circumstances, it would be considered that in place of the magnet, a magnetic plate is provided spaced by a predetermined small gap at the end of the developing sleeve. Since the magnetic plate is magnetized by the inside magnet roller of the developing sleeve, magnetic chains of a proper intensity can be formed, and therefore, the rubbing of the developer relative to the magnetic chains between the developing sleeve and the end magnet can be reduced. However, a low magnetic field region (repelling region) exists along the circumferential direction of the magnet roller, where the same magnetic poles are adjacent to each other, and therefore, the magnetic plate thus disposed is not easily magnetized, which results in difficulty of achieving an assured sealing property.

SUMMARY OF THE INVENTION

Accordingly, it is a principal object of the present invention to provide a developing apparatus including a developing sleeve and a magnet therein, wherein a repelling region is provided along the circumferential direction, and wherein even if a sealing member for magnetically sealing the end portion of the sleeve, the removal and therefore the leakage of the toner at the boundary area between the confining region and the fluid region of the developer in the seal portion can be suppressed.

According to an aspect of the present invention, there is provided a developing apparatus comprising a developing container for accommodating the developer including magnetic particles; a developer carrying member, rotatably provided in said developing container, for carrying the developer to a region where said developer carrying member is opposed to said image bearing member; a magnet, stationarily provided in said developer carrying member, having a pair of magnetic poles of the same polarity adjacent to each other in a circumferential direction of said developer carrying member; a magnetic seal portion, provided in said developing container so as to oppose to said developer carrying member along a circumferential direction at a axial end of said developer carrying member, for contacting the developer confined by a magnetic field formed between said developer carrying member and said magnetic seal portion to said developer carrying member to effect sealing; wherein said magnetic seal portion is provided with a magnet member only in a region opposing said pair of magnetic poles, and said magnet member having magnetic poles of the same polarity as the magnetic poles of said magnet which are opposed to the magnetic poles of the same polarity, and in a region where the same polarity poles are not opposed, a magnetic member which is magnetized by said magnetic field generating means.

These and other objects, features, and advantages of the present invention will become more apparent upon consideration of the following description of the preferred embodiments of the present invention, taken in conjunction with the accompanying drawings.

DETAILED DESCRIPTION OF THE EMBODIMENT (Embodiment 1)

The preferred embodiments of the present invention will be described in conjunction with the accompanying drawings. First, an image forming apparatus to which the developing apparatus of the present invention is applicable.

<General Arrangement of Image Forming Apparatus to which Developing Apparatus of the Present Invention is Applicable>

Figure 1:
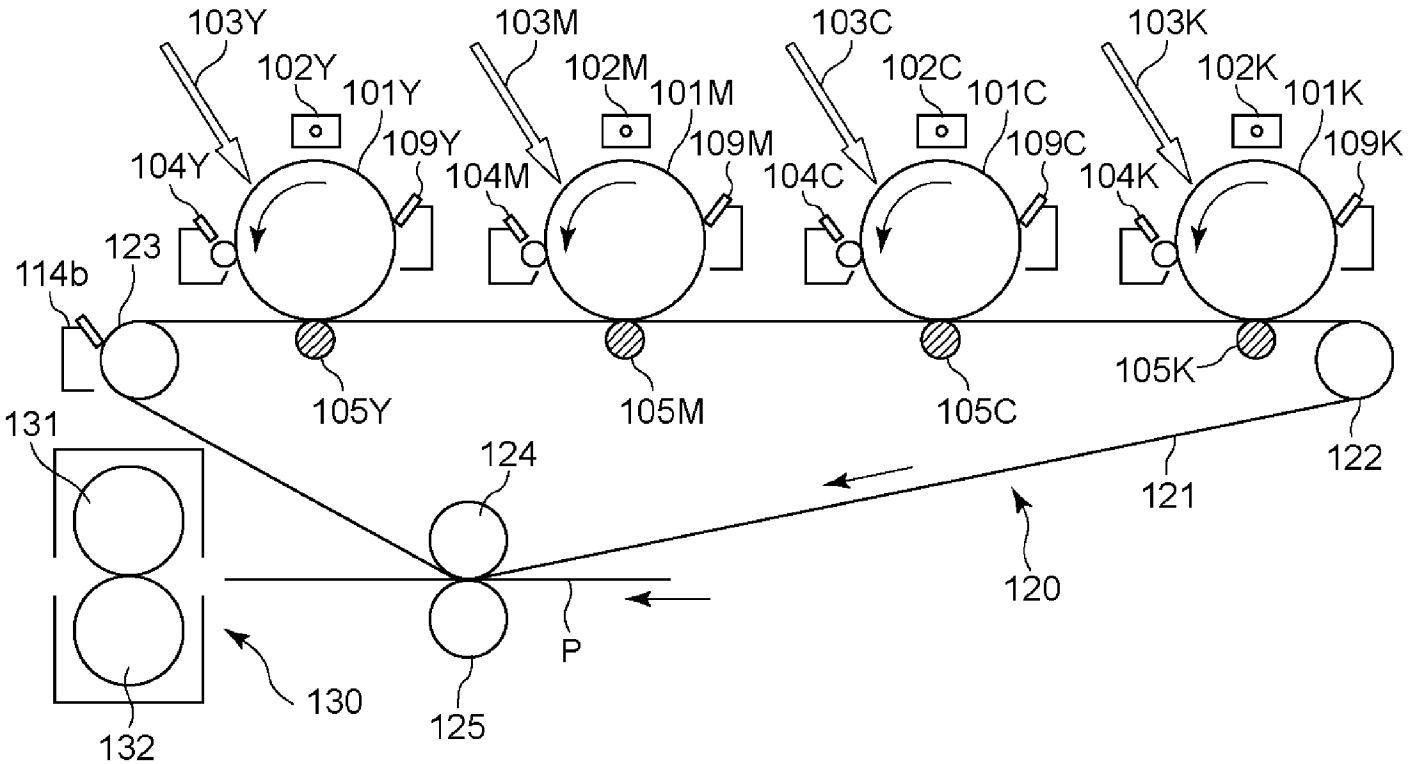
FIG. 1 is a schematic view of an image forming apparatus for which the present invention is applicable.

As shown in FIG. 1, the image forming apparatus to which the present invention is applicable comprises four image forming stations Y, M, C and K each including a photosensitive drum 101 (101Y, 101M, 101C, 101K) as a latent image bearing member. Below each image forming station, there is provided an intermediary transferring device 120. The intermediary transferring device 120 includes an intermediary transfer belt 121 as an intermediary transfer member which is stretched by rollers 122, 123, 124 and which travels in a direction indicated by the arrow.

In this embodiment, a surface of the photosensitive drum 101 is charged by a primary charging device 102 (102Y, 102M, 102C, 102K) of a corona charging type. It is exposed to a laser 103 (103Y, 103M, 103C, 103K) actuated by a laser driver (unshown), so that an electrostatic latent image is formed on the photosensitive drum 101. The latent images thus formed are developed by developing devices 104 (104Y, 104M, 104C, 104K) so that yellow magenta cyan black toner images are formed.

The toner images formed by the image forming station are transferred superimposedly onto an intermediary transfer belt 121 of polyimide resin material by a transfer roller 105 (105Y 105M, 105C, 105K) as a primary transferring means supplied with a transfer bias. Four color toner images formed on the intermediary transfer belt 121 are transferred onto a recording paper P by a secondary transfer roller 125 as secondary transferring means provided opposed to a roller 124. The toner remaining on the intermediary transfer belt 121 without being transferred to the recording paper P is removed by an intermediary transfer belt cleaner 114*b*. The recording paper P having the transferred toner image is pressed and heated by a fixing device 130 provided with fixing rollers 131, 132, into a permanent image. The primary-untransferred toner remaining on the photosensitive drum 101 later the primary transfer is removed by a cleaner 109 (109Y, 109M, 109C, 109K) to be prepared for next image formation.

<Structures Around Photosensitive Drum of Image Forming Apparatus>

Figure 2:
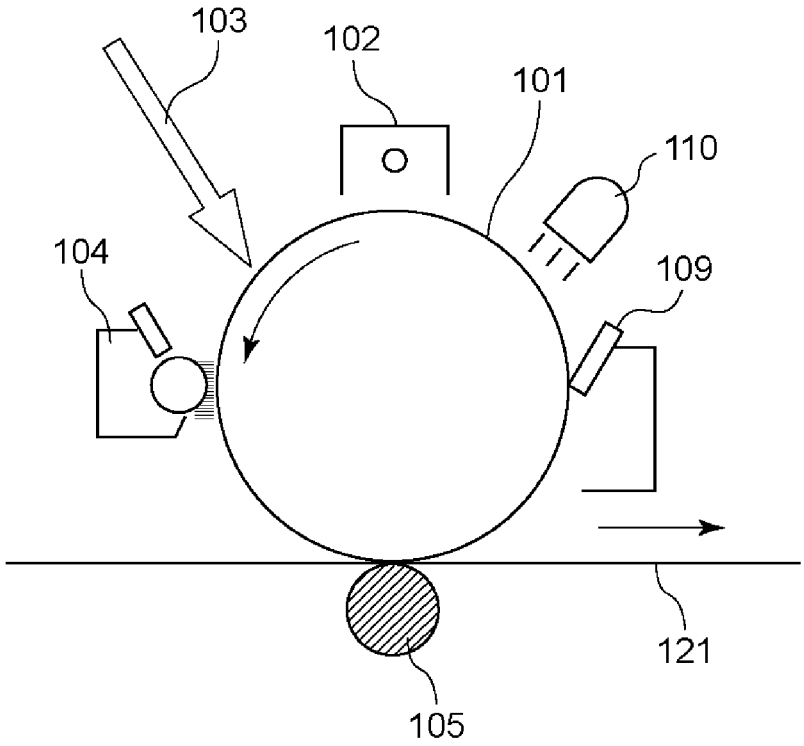
FIG. 2 is a schematic view around the photosensitive drum of the image forming apparatus.

Referring to FIG. 2, the description will be made as to the structures around the photosensitive drum as the latent image bearing member of the image forming apparatus to which the developing apparatus of the present invention is applicable. The structures around the respective photosensitive drums are the same, and therefore, the description will be made as to one color.

In FIG. 2, a photosensitive drum 101 as the electrostatic latent image bearing member is rotatable. The surface of the photosensitive drum 101 uniformly charged by the non-contact charging type (corona type) primary charger 102 is exposed by a laser beam emission element 103 so that an electrostatic latent image is formed on the photosensitive drum 101. The electrostatic latent image is visualized by a developing apparatus 104. Subsequently, the visualized image is transferred onto the intermediary transfer belt 121 with primary transfer roller 105. The untransferred toner on the photosensitive drum 101 is removed by a cleaning blade which is a contact type cleaning device 109. A potential on the photosensitive drum is erased (removed) by a pre-exposure lamp 110.

<Structure of Developing Apparatus>

Figure 3:
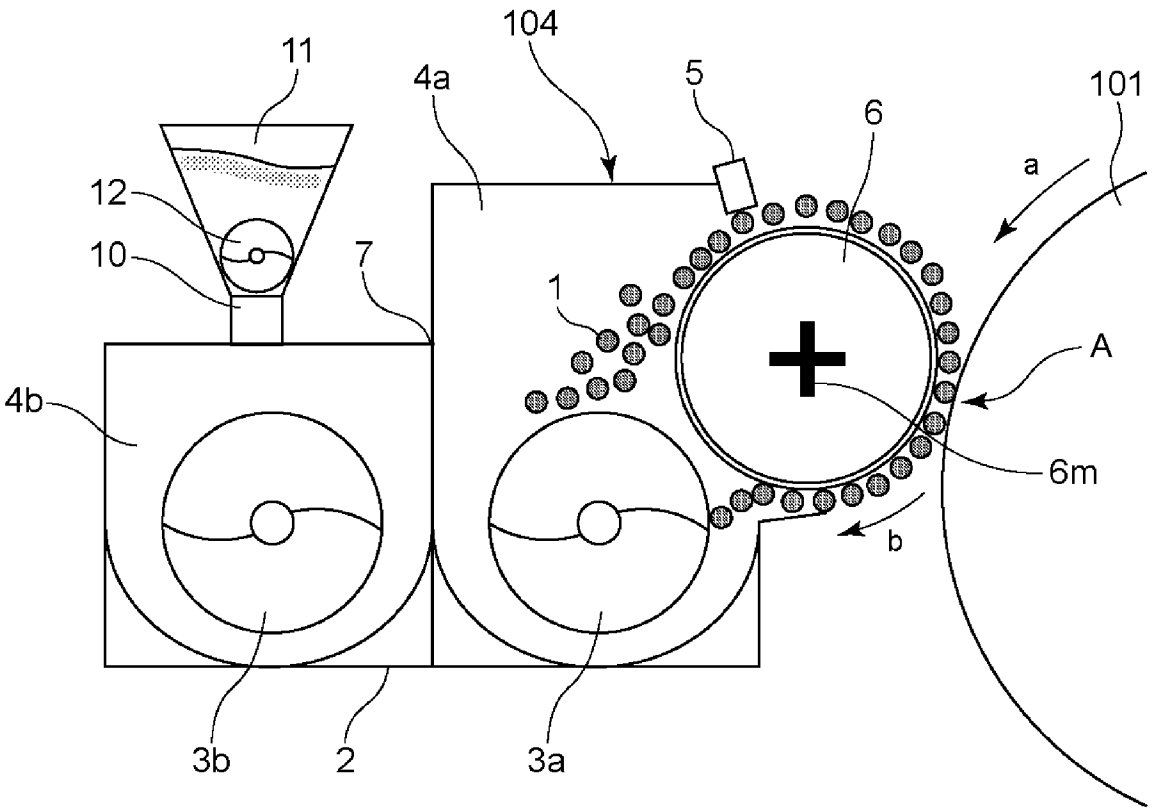
FIG. 3 is a schematic view (sectional view) of a developing apparatus according to Embodiment 1 of the present invention.
Figure 4:
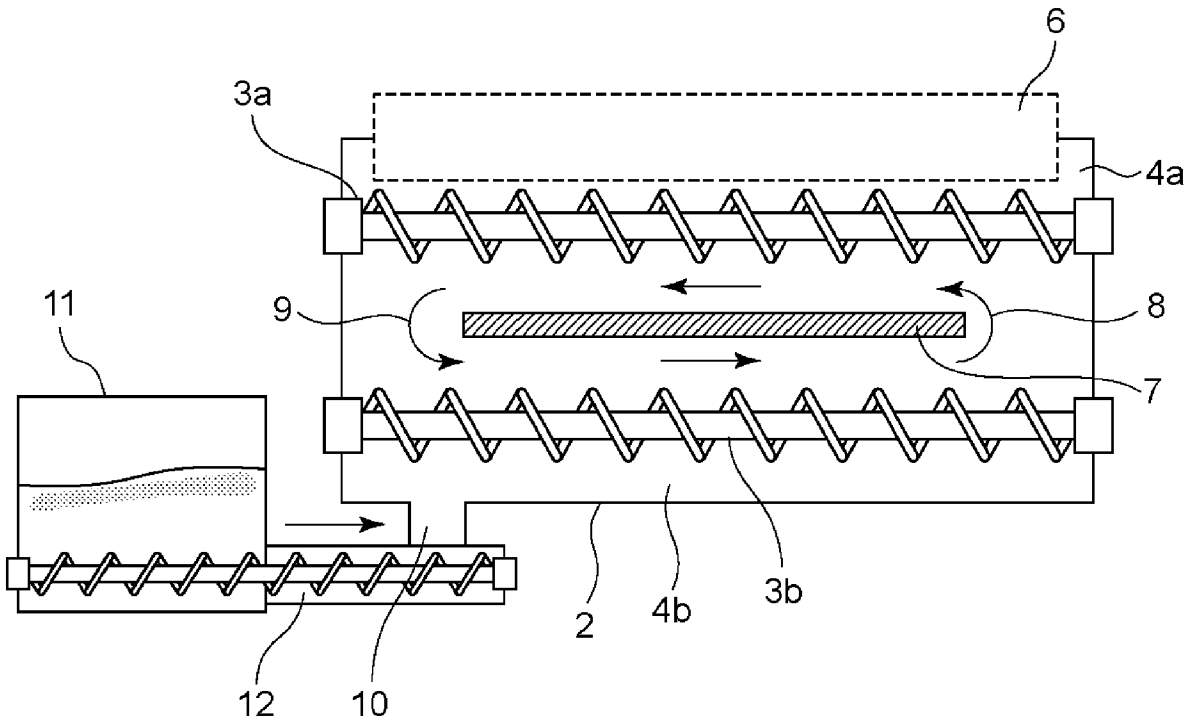
FIG. 4 is a schematic view (longitudinal) of the developing apparatus of Embodiment 1.

Referring to FIGS. 3 and 4, the developing apparatus 104 will be described in detail. In this embodiment, the developing apparatus 104 comprises a developing container 2 in which developer 1 containing toner and carrier particles is accommodated. The developing apparatus 104 further comprises a developing sleeve 6 as developer carrying means in the developing container 2, and the developing sleeve 6 carries the developer in a developer feeding direction b. The developing apparatus 104 further comprises a chain cutting member 5 for regulating the chains of the developer carried on the developing sleeve 6.

In this embodiment, the inside of the developing container 2 is divided, at substantially the central portion thereof, into left and right regions, that is, a developer chamber 4*a* and a stirring chamber 4*b* by a partition 7 extending in the direction perpendicular to the sheet of the drawing.

In the developer chamber 4*a* and the stirring chamber 4*b*, there are provided first and second feeding screws 3*a*, 3*b* which are feeding members as feeding means. The first feeding screw 3*a* extends substantially parallel with an axial direction of the developing sleeve 6 at a bottom portion of the developer chamber 4*a*, and it feeds the developer in the developer chamber 4*a* along the axial direction in one direction by the rotation thereof. The second feeding screw 3*b* extends substantially parallel with the first feeding screw 3*a* at the bottom portion in the stirring chamber 4*b*, and it feeds the developer in the stirring chamber 4*b* in a direction opposite that of the first feeding screw 3*a*.

Thus, by the feeding operation by the rotation of the first and second feeding screws 3*a*, 3*b*, the developer is circulated between the developer chamber 4*a* and the stirring chamber 4*b* through the openings (communicating portions) 8, 9 of the opposite ends of the partition 7.

In this embodiment, the developer chamber 4*a* and the stirring chamber 4*b* are arranged horizontally, but this is not inevitable, and the developer chamber 4*a* and the stirring chamber 4*b* may be arranged vertically or in another direction.

In this embodiment, there is provided an opening at a position of the developing zone A opposed to the photosensitive drum 101 of the developing container 2, the developing sleeve 6 is partly exposed toward the photosensitive drum through the opening and is rotatable.

In this embodiment, a diameter of the developing sleeve 6 is 20 mm, the diameter of the photosensitive drum 101 is 80 mm, and a gap between the developing sleeve 6 and the photosensitive drum 101 in the closest region therebetween is approx. 300 μm. With such a structure, the developing operation is carried out while the developer 1 carried to the developing zone is contacted to the photosensitive drum 101. The developing sleeve 6 is made of a non-magnetic material such as aluminum or stainless steel, and encloses a magnet roller 6*m* which is magnetic field generating means non-rotatably.

With such a structure, the developing sleeve 6 rotates in the direction indicated by an arrow b (clockwise direction) during the developing operation, so that a layer of the developer 1, a layer thickness of which is regulated by the chain cutting of the magnetic brush by the chain cutting member 5 is carried on the developing sleeve 6. The developing sleeve 6 carries such a developer to the developing zone A where it is opposed to the photosensitive drum 101, and supplies the developer to the electrostatic latent image formed on the photosensitive drum 101 thereby to develop the latent image. At this time, the developing sleeve 6 is supplied with a developing bias voltage in the form an AC voltage biased with a DC voltage from an unshown voltage source in order to improve the toner application rate to the latent image (development efficiency). In this embodiment, the AC voltage have a DC voltage component of the −500V, peak-to-peak voltage Vpp of 1800V and a frequency f of 12 kHz. However, the DC voltage value and the AC voltage waveform are not limited to these values.

Generally, in the magnetic brush developing method, when a AC voltage is applied, the development efficiency increases and therefore the high quality image is formed, but the fog tends to occur. Therefore, a potential difference is provided between the DC voltage applied to the developing sleeve 6 and the charged potential of the photosensitive drum 101 (white background portion potential), thus preventing the fog.

The regulating blade 5 which is the chain cutting member is a plate-like member extending along the longitudinal axis of the developing sleeve 6. The material of the regulating blade 5 is a non-magnetic material such as aluminum or stainless steel or the like or a magnetic low-carbon steel material such as SPCC or the like, or a composite plate including non-magnetic material and said magnetic material. The regulating blade 5 is disposed upstream of the photosensitive drum 101 with respect to the rotational moving direction of the developing sleeve. Both of the toner and the carrier of the developer passes through between the free end portion of the chain cutting member 5 and the developing sleeve 6 toward the developing zone A.

By adjusting the gap between the regulating blade 5 and the surface of the developing sleeve 6, the chain cutting amount of the magnetic developer brush carried on the developing sleeve 6 is regulated so that the amount of the developer fed to the developing zone is adjusted. The gap between regulating blade 5 and the developing sleeve 6 is 200-1000 μm, preferably 300-700 μm. In this embodiment, it is 500 μm.

In the developing zone A, the peripheral surface of the developing sleeve 6 of the developing apparatus 104 moves codirectionally with moving direction of the photosensitive drum 101, wherein a peripheral speed ratio relative to the photosensitive drum is 2.0. The peripheral speed ratio is 0-3.0 times, preferably 0.5-2.0 times. With increase of the moving speed ratio, the development efficiency increases, but if it is too large, another problem such as toner scattering or developer deterioration the may arise, and therefore, these ranges are preferable.

<Supplying Method of Developer to Developing Apparatus>

Referring to FIGS. 3 and 4, the developer supplying method in this embodiment will be described.

Above the developing apparatus 104, a hopper 11 for accommodating the supply of the developer (normally, toner/supply developer 100-80%) which is a mixture of the toner and the carrier is provided. The hopper 11 constituting toner supplying means is provided with a screw supplying member (supplying screw 12) in a lower portion, and one end of the supplying screw 12 extends to the position of a developer supply opening 10 provided in a front end of the developing apparatus 104. In FIG. 4, the developer is supplied from a side surface of a stirring chamber for better illustration, but actually the developer is supplied from an upper part of the stirring chamber.

An amount of the toner consumed by the image formation is supplied from the hopper 11 by the rotational force of the supplying screw 12 and the gravity to the developer through the developer supply opening 10 into the developing container 2. The amount of the supply developer supplied into the developing apparatus 104 from the hopper 11 is generally determined by the rotational frequency of the supplying screw 12. The rotational frequency is determined by toner supply amount control means (unshown) on the basis of a video count of the image data and/or a result of detection by-the unshown toner content detecting means provided in the developing container 2.

<Developer of Developing Apparatus>

The description will be made as to the developer comprising the toner and the carrier accommodated in the developing container 2 of the developing apparatus 104 in more detail.

The toner comprises coloring resin material particles including a binder resin, a coloring material, and an additive if necessary, and an externally added material such as fine colloidal silica particles. The toner is a polyester resin material having a negative charging property, and a volume average particle size thereof is not less than 2 μm and not more than 10 μm, preferably. Further preferably, it is not more than 8 μm. Recently, in order to improve the fixing property, low melting point toner or toner having a low glass transition point Tg (Tg ≤70° C., for example) is frequently used. Furthermore, in order to improve the separation property, the toner comprises wax in some cases.

The material of the carrier is surface-oxidized or un-oxidized metal such as iron, nickel, cobalt, manganese, chromium, rare earth or the like, or an alloy thereof, or oxide ferrite, preferably, and the manufacturing method is not limited. A weight average particle size of the carrier is 20-60 μm, preferably 30-50 μm, and the resistivity is not less than 10^7 Ωcm, preferably not less than 10^8 Ωcm. In this embodiment, it is 10^8 Ωcm.

A volume average particle size of the toner used in this embodiment was measured by the following device and method. The measuring device is the SD-2000 Sysflow electric resistance type particle size distribution measuring device (available from sysmex Corporation). The measuring method is as follows. That is, to 100-150 ml of the electrolytic solution, 0.1 ml of a surfactant as a dispersant, preferably, alkylbenzenesulfonic acid salt, was added, and to this mixture, 0.5-50 mg of a measurement sample was added. Then, the electrolytic solution in which the measurement sample was suspended was subjected to dispersion in an ultrasonic dispersing device for about 1-3 minutes. A particle size distribution of the particles of 2-40 μm by the SD-2000 Sysflow electric resistance type particle size distribution measuring device using a 100 μm aperture. The volume average particle size is obtained from the volume average distribution thus obtained.

The resistivity of the magnetic carrier was measured by using a cell of the sandwich type with a measurement electrode area of 4 cm^2 and an electrode gap of 0.4 cm. A voltage E (V/cm) was applied between two electrodes of the cell under application of 10 N (1 kg) of load on one electrode of the cell, to measure the resistivity of the carrier obtained from the amount of the current which passed through the circuit.

The description will be made as to a relation between the structure of the end portion of the developing container and a magnetic pole pattern of the magnet roller fixed non-rotatably in the developing sleeve, and as to a mechanism of toner leakage suppression according to the present invention.

<Magnetic Pole Pattern of the Magnet Roller in Developing Sleeve and Feeding of Developer>

Figure 5:
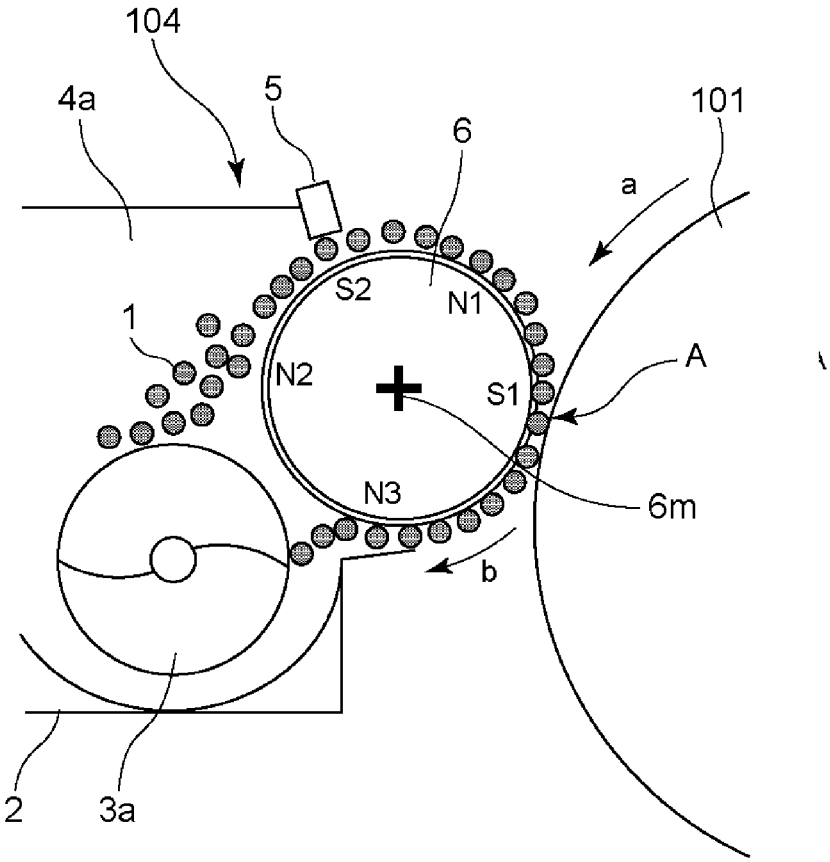
FIG. 5 is a schematic view around a developing sleeve of the developing apparatus of Embodiment 1.

Referring to FIG. 5, the detail of the magnet roller fixed non-rotatably in the developing sleeve and behavior of the developer fed on the developing sleeve in this embodiment will be described.

In the developing sleeve 6, magnetic field generating means in the form of a roller **6*m* is fixed. The magnet roller 6*m* has a developing magnetic pole S1 to the developing zone A. By the developing magnetic field formed in the developing zone A by the developing magnetic pole S1, the magnetic brush of the developer is formed, and the magnetic brush contacts the photosensitive drum 101 rotating in the direction indicated by the arrow a in the developing zone A to develop the electrostatic latent image. The magnet roller 6*m* includes the developing magnetic pole S1, and four additional poles N1, N2, N3, S2, among which N2 pole and N3 pole have the same polarity and are adjacent to each other within the developer container 2 to form a barrier against the developer 1**.

The developer 1 is fed and flipped up by the first feeding screw and is trapped by the N2 pole (scooping pole) of the developing sleeve 6. With rotation of the developing sleeve 6, the developer is fed in the order of N2, S2 (cutting pole), N1 (feeding pole), S1 (developing pole), N3 (peeling pole). The N3 pole and the N2 pole are the same in the polarity and are adjacent to each other within the developer container 2 to form the barrier against the developer 1, and therefore, the developer is released from the magnetic confining force of the magnetic pole to return to the first feeding screw.

In the developing apparatus 104 of this embodiment, a gap between the chain cutting member 5 and the developing sleeve 6 is adjusted so that a mass of the developer per unit area fed on the developing sleeve 6 is 23-35 mg/cm^2 during the operation. The surface of the developing sleeve 6 has unsmoothness, by which friction between the developer and the developing sleeve is positively enhanced to assure a sufficient feeding amount of the developer. As for a method for producing proper unsmoothness on the surface of the developing sleeve, there are two methods (the present invention employs blast treatment).

(1) Blast Treatment:

To a bare tube metal extruded under a high temperature, for example, particle such as grinding powder or glass beads having a predetermined particle size distribution is blasted with high pressure under a cold state. The depth of unsmoothness at the surface is approx. 5-15 μm, and the developer feeding power increases with increase of the depth.

(2) Grooving Process

A bare tube metal extruded under a high temperature, for example, is cold-drawn, and grooves are formed by a die. A configuration of the grooves is ordinarily V, trapezoidal or U shape in cross-section. The deep of the groove is approx. 50-150 μm from the surface of the developing sleeve, and the number of the grooves is ordinarily 50-120 for a sleeve having a diameter of 20 mm. The feeding power increases with increase of the number of the grooves.

<Structure of End Portion of Developing Apparatus>

The structure of the end portion of the developing apparatus will be described. The developer 1 is transported by a circulative movement in the developing container 2 along the surface of the developing sleeve 6 toward a bearing 14 for the developing sleeve 6 shown in FIG. 7. The occurrence of the rotation defect of the developing sleeve 6 attributable to the leakage of the developer through the opening and the developer entering the bearing 14 is to be prevented. For this purpose, a plate-like magnet member (end magnet 13) is provided as a magnetic sealing member with a predetermined gap along the circumferential direction of the developing sleeve 6 at the axial end of the developing sleeve 6.

Figure 6:
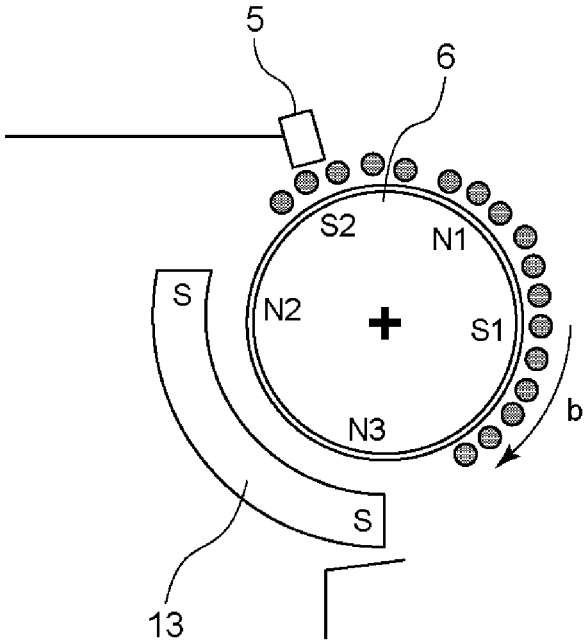
Fig. 6 (PRIOR ART)
FIG. 6 is a schematic view (sectional) of an end portion of a developing sleeve of a conventional developing apparatus.
Figure 7:
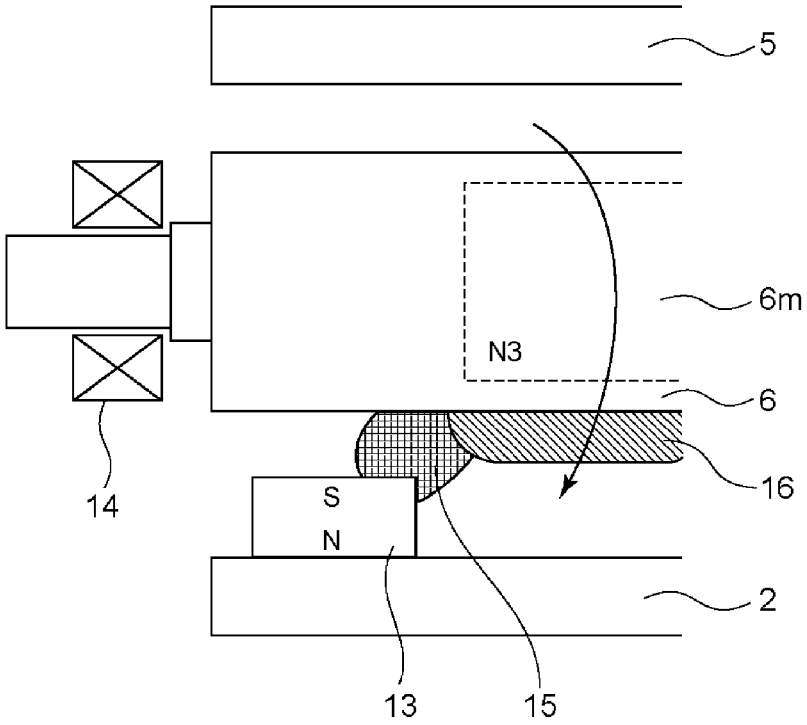
Fig. 7 (PRIOR ART)
FIG. 7 is a schematic view (longitudinal) of an end portion of a developing sleeve of a conventional developing apparatus.

In a prior art structure, the end magnet 13 has a N pole on one side and a S pole on the other back side. As shown in FIGS. 6 and 7, such a surface of the end magnet 13 has an opposite polarity pole (N2 pole and N3 pole) forming a repelling magnetic field with the magnet roller 6*m* in the developing sleeve 6 faces the developing sleeve 6 side. In this case, the magnetic force lines extend between the developing sleeve 6 and the end magnet 13 to form magnetic chains of the developer, thus preventing the leakage of the developer.

As described in the foregoing, however, with the conventional structure, the toner leakage is unavoidable although the developer leakage can be prevented. The toner leakage mechanism will be described here. In the case of the opposite polarity poles opposed to each other as with the conventional structure, the magnetic force lines extend between the S pole surface of the end magnet 13 and the N3 pole of the magnet roller 6*m*, for example, as shown in FIG. 7, and therefore, the magnetic chains of the developer confined by the magnetic force lines are formed. The developer of the magnetic chains is confined by strong magnetic forces, and therefore, even when the developer circulates in the developing container enters it, no exchange of the developer occurs, and the developer is retained. The region in which the magnetic chains of the developer thus confined is shown in FIG. 7 by cross-hatching (region 15). On the other hand, the region in which the developer moves by the rotation of the developing sleeve 6 is shown by hatching (region 16) in FIG. 7. As a result, there is a moving speed (fluid speed) difference of the developer at the boundary between the region 15 in which the developer is confined at rest and the region 16 in which the developer moves (flows). At the interfacial boundary with the fluid speed difference of the developer, a shear plane exists where the developer particles in the regions rub to each other, with the result of separation and agglomeration. The separated or agglomerated toner leaks to the outside of the developing container 2 through the gap between the end magnet 13 and the developing sleeve 6. Thus, the toner leakage occurs in the prior art.

Figure 8:
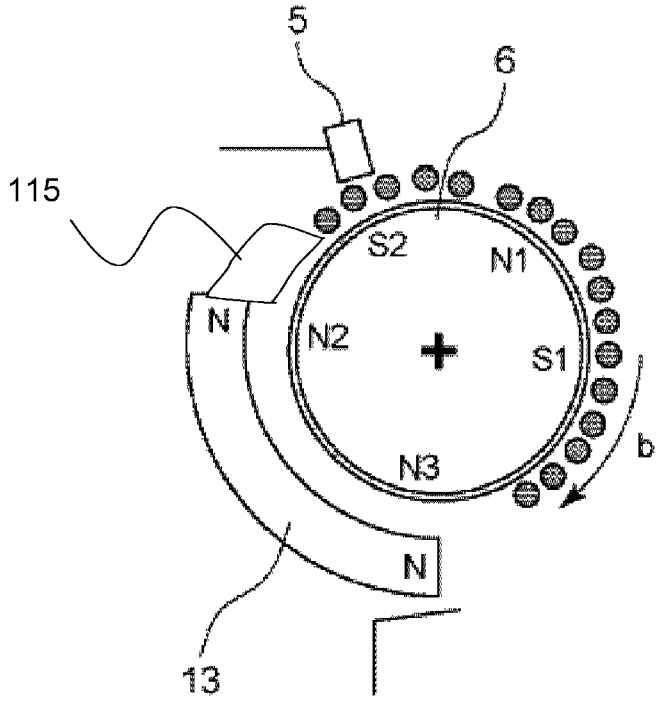
FIG. 8 is a sectional schematic view of an end portion of a developing sleeve of the developing apparatus of Embodiment 1.
Figure 9:
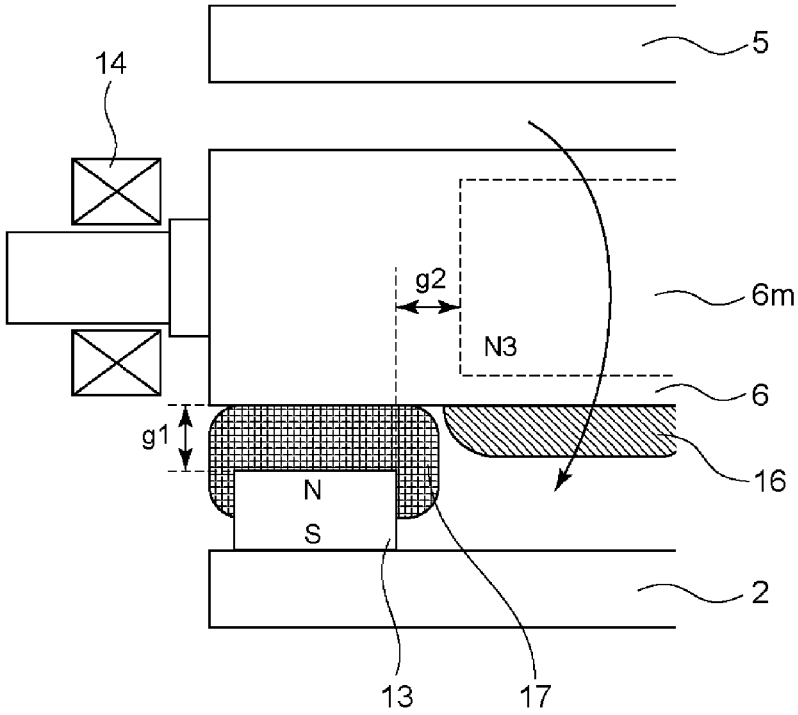
FIG. 9 is a schematic view (longitudinal) of an end portion of the developing sleeve of the developing apparatus of Embodiment 1.

Under the circumstances, the structure shown in FIGS. 8 and 9 is employed in this embodiment. The structure is effective to prevent the toner leakage and the developer leakage. The end magnet 13 has a side which face the developing sleeve 6 side and which has the same polarity as the magnetic pole (N2 pole and N3 pole) of the magnet roller 6*m* opposed thereto. More particularly, in this embodiment, the end magnet is disposed so that the surface thereof opposed to the magnetic poles (peak magnetic force positions) has the same magnetic polarity as those of the magnet roller. More preferably, the pole of the end magnet is opposed to the same polarity pole of the magnet roller in the half-peak width region of the pole of the magnet roller. By doing so, in the magnetic force peak region of each magnetic pole, no opposite polarity pole exists, and therefore, no stationary layer is formed.

At this time, adjacent to the N3 pole, for example, of the magnet roller 6*m*, as shown in FIG. 9, a repelling magnetic field is produced between the N pole surface of the end magnet 13. As a result, the region 17 of the developer retained by the end magnet 13 is spaced from the region 16 in which the developer flows with rotation of the developing sleeve 6. The developer having entered the fine gap between the region 16 and the region 17 moves slowly by being entrained by the flowing developer in the region 16. Therefore, with the structure of this embodiment according to the present invention, no shear plane between the developers in the regions is produced, so that the separation and the agglomeration and therefore the toner leakage can be prevented. As regards the developer leakage, the region 17 of the developer retained by the end magnet 13 sufficiently fills the gap between the developing sleeve 6 and the end magnet 13, including also circumferential direction, and therefore, no gap letting the developer leak exists, so that the developer leakage can be prevented.

In the developing apparatus of the this embodiment, a magnetic flux density of the end magnet 13 is 700G Gauss, and the gap g1 between the developing sleeve 6 and the end magnet 13 is 650 μm, and a gap g2 in the longitudinal direction between the magnet roller 6*m* and the end magnet 13 is 2.0 mm. If, however, the magnetic force of the end magnet 13, for example, the region 17 of the developer retained by the end magnet 13 becomes small, and therefore, with the result that a gap appears between the developing sleeve 6 and the region 17 and the developer leakage may occur. In view of this, the gap g1 between the developing sleeve 6 and the end magnet 13 or the gap g2 in the longitudinal direction between the magnet roller 6*m* and the end magnet 13 are required to be small. In this embodiment of the present invention, magnetic force of the end magnet 13 and the positional relation between the end magnet 13 and the developing sleeve 6 are properly adjusted.

It is desirable that the end magnet 13 is a rubber magnet (produced by kneading magnetic powder and rubber) or a neodymium magnet magnetized to provide a magnetic flux density of 400-1000 G, for example. If the magnetic flux density is not more than 400 G (Gauss) thereof, the formation of the magnetic chains of the developer is not sufficient with the possible result of developer leakage, and therefore, such a magnetic flux density is not desirable. In order to paste it into an arcuate shape along the developing sleeve, a rubber magnet having a proper elasticity is suitable. The gap gl between the end magnet 13 and the developing sleeve 6 is desirably approx. 300-2000 μm, and the gap g2 in the longitudinal direction between the end magnet 13 and magnet roller 6*m* is desirably approx. 0.5-2.5 mm from the standpoint of the prevention of the developer leakage. More preferably, the gap gl between developing sleeve 6 and the end magnet 13 is 500-800 μm, and the magnetic flux density of the end magnet 13 is 530-700 G.

As for the developer seal in the region from a downstream of the N2 pole (scooping pole) to the zone opposing to the S2 pole (cutting pole) and the chain cutting regulating member 5, the conventional technique using a magnetic seal by a magnetic plate 115, in this embodiment. By doing so, the sliding of the magnetic chain can be reduced as compared with the case in which an opposite polarity pole of the magnet is provided by the magnetization of the magnetic plate. In addition, as compared with the provision of a magnet, the control of the intensity of the magnetic force is unnecessary.

Between the adjacent repelling poles (between N2 pole and N3) of the same polarity, a zero magnetic field region exists, and therefore, the magnetic plate alone may be insufficient to magnetically seal the developer. However, in the region downstream of the N2 pole, there is no zero magnetic field region, and therefore, the magnetic seal by magnetic plate is enough.

In the case that a magnet with which the polarities are all the same as those of the magnet roller, the magnet has to have strong magnetic forces, as described hereinbefore. Then, strong magnetic force line extends from the magnet to the developing sleeve at the position where the polarity switches, with the result of production of a shear plane between the stationary layer and the fluid layer. However, according to this embodiment, the magnetic plate seal is used except for the repelling region, and therefore, not such a strong magnetic field as forms the shear plane is formed, so that the toner leakage can be sufficiently suppressed.

(Embodiment 2)

The structures of this embodiment is similar to Embodiment 1. Therefore, the description will be made as to the different portions.

In above-described Embodiment 1, the toner leakage is prevented, and on the other hand, the developer leakage is also prevented, and therefore the end magnet provides the magnetic flux density of 700 G (Gauss).

Figure 10:
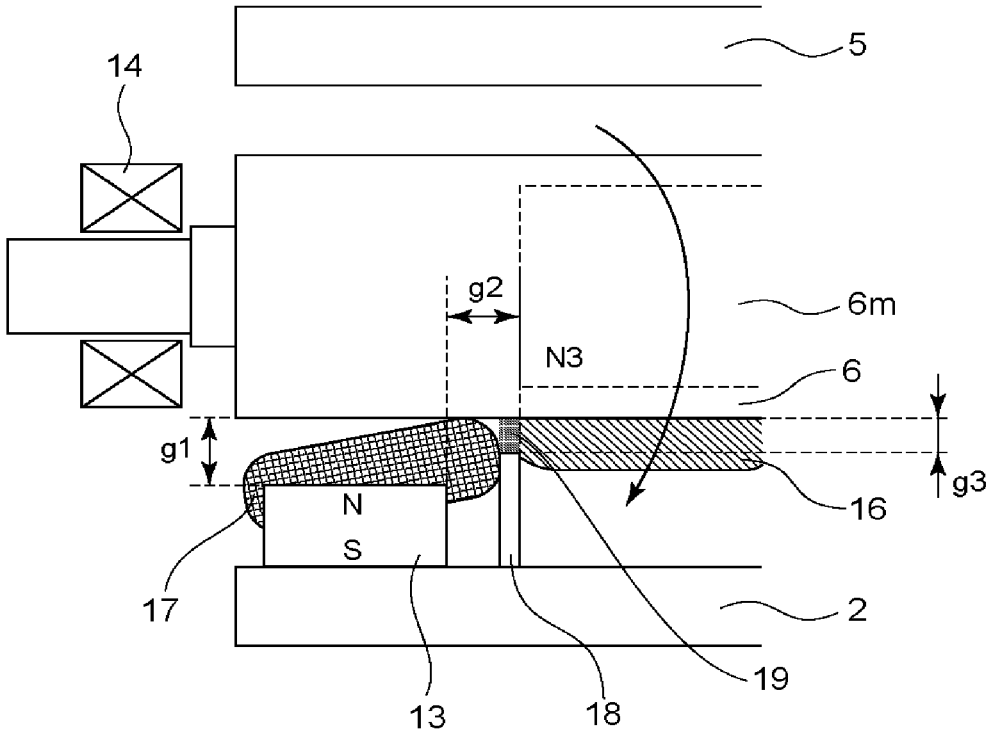
FIG. 10 is a schematic view (longitudinal) of an end portion of the developing sleeve of the developing apparatus of Embodiment 2.

In this embodiment, an additional magnetic end plate is provided in a region of the end magnet in the circumferential direction of the magnet roller 6*m*, by which the latitude for the developer leakage can be expanded. Referring to FIG. 10, the end structure of the developing apparatus according to this embodiment will be described.

<Structure of End Portion of Developing Apparatus>

Also in this embodiment, the end magnet 13 has a side having the same polarity as the magnetic pole (N2 pole and N3 pole) of the magnet roller 6*m* provided in the developing sleeve 6, and the side is faced to the developing sleeve 6, similar to Embodiment 1. The structure as seen in a section of the end portion of the developing apparatus is similar to FIG. 8. At this time, in Embodiment 1 as shown in FIG. 9, adjacent to the N3 pole of the magnet roller 6*m*, a repelling magnetic field is produced between the N pole surface of the end magnet 13 However, in this embodiment, as shown in FIG. 10, an additional magnetic end plate 18 is provided, so that magnetic chains of the developer are produced between the end magnet 13 and the magnetic end plate 18, and in addition, magnetic chains of the developer are produced between the magnetic end plate 18 and the magnetic pole N3 of the magnet roller 6*m*. As a result, the magnetic chains 19 extended by the magnetic force lines between the magnetic end plate 18 and the magnet roller 6*m* suppress occurrence of the developer leakage. The developer partly leaked is confined by the magnetic force lines between the end magnet 13 and the magnetic end plate 18, and is retained by the end magnet 13 in the region 17, and the developer leakage can be suppressed. As regards the toner leakage, there is a gap between the region 17 of the developer retained by the end magnet 13 and the region 16 of the developer flowing by the feeding of the developing sleeve 6, and therefore, no shear plane is produced between developers similarly to Embodiment 1. In addition, the magnetic chains 19 between the magnetic end plate 18 and the magnet roller 6*m*, are in the region 16 of the developer which moves by the feeding of the developing sleeve 6, and therefore, it always moves to cause replacement of the developer. As a result, in the neighborhood of the magnetic chain, no shear plane due to the sliding between the developers appears. In the case of a magnetic member, the confining force to the developer is weaker than in the case of magnet seal. By employing the magnetic end plate 18, a developing apparatus can be provided wherein the toner leakage and the developer leakage are suppressed simultaneously.

In this embodiment of the developing apparatus, the magnetic flux density of the end magnet 13 is 700G (Gauss), and the gap g1 between the developing sleeve 6 and the end magnet 13 is 650 μm. The gap g2, in the longitudinal direction, between the magnet roller 6*m* and the end magnet 13 is 2.0 mm, the thickness of the magnetic end plate 18 is 1.0 mm, and an inside end of the magnetic end plate 18 with respect to the longitudinal direction is substantially at the same position as the outer end of the magnet roller 6*m*. If, however, the magnetic force of the end magnet 13, for example, the region 17 of the developer retained by the end magnet 13 becomes small, and therefore, with the result that a gap appears between the developing sleeve 6 and the region 17 and the developer leakage may occur. In view of this, the gap g1 between the developing sleeve 6 and the end magnet 13 or the gap g2 in the longitudinal direction between the magnet roller 6*m* and the end magnet 13 are required to be small. In this embodiment of the present invention, magnetic force of the end magnet 13 and the positional relation between the end magnet 13 and the developing sleeve 6 are properly adjusted.

It is desirable that the end magnet 13 is a rubber magnet (produced by kneading magnetic powder and rubber) or a neodymium magnet magnetized to provide a magnetic flux density of 400-1000 G, for example.

If the magnetic flux density is not more than 400 G (Gauss) thereof, the formation of the magnetic chains of the developer is not sufficient with the possible result of developer leakage, and therefore, such a magnetic flux density is not desirable. In order to paste it into an arcuate shape along the developing sleeve, a rubber magnet having a proper elasticity is suitable. The gap g1 between the end magnet 13 and the developing sleeve 6 is desirably approx. 300-2000 μm, and the gap g2 in the longitudinal direction between the end magnet 13 and magnet roller 6*m* is desirably approx. 0.5-2.5 mm from the standpoint of the prevention of the developer leakage.

The magnetic end plate 18 is preferably made of a ferromagnetic material such as iron, nickel, cobalt or an alloy thereof, and the thickness thereof is preferably approx. 0.2-

1.0 mm. A gap g3 between the magnetic end plate 18 and the developing sleeve 6 in the circumferential direction is 500 μm in this embodiment, and the magnetic end plate 18 is disposed at a position closer to the surface of the developing sleeve 6 than the end magnet 13. However, the gap between the magnetic end plate 18 and the developing sleeve 6 is not limited to this range, and can be properly selected by ordinary skilled in the art in the range of 0.3-2.0 mm approx.

(Embodiment 3)

This embodiment is common with Embodiments 1 and 2 in the fundamental concept, but the developing apparatus comprises a plurality of developing sleeves.

In such a case, magnet patterns of the developing sleeves are different from each other, and the arrangement of the end magnets is different.

Because of the similarity to Embodiments 1 and 2, the description is omitted as to the image forming apparatus, the structure around the photosensitive drum and the structure of the developer. The portions of the developing apparatus different from Embodiments 1 and 2 will be described.

<Structure of Developing Apparatus>

Figure 11:
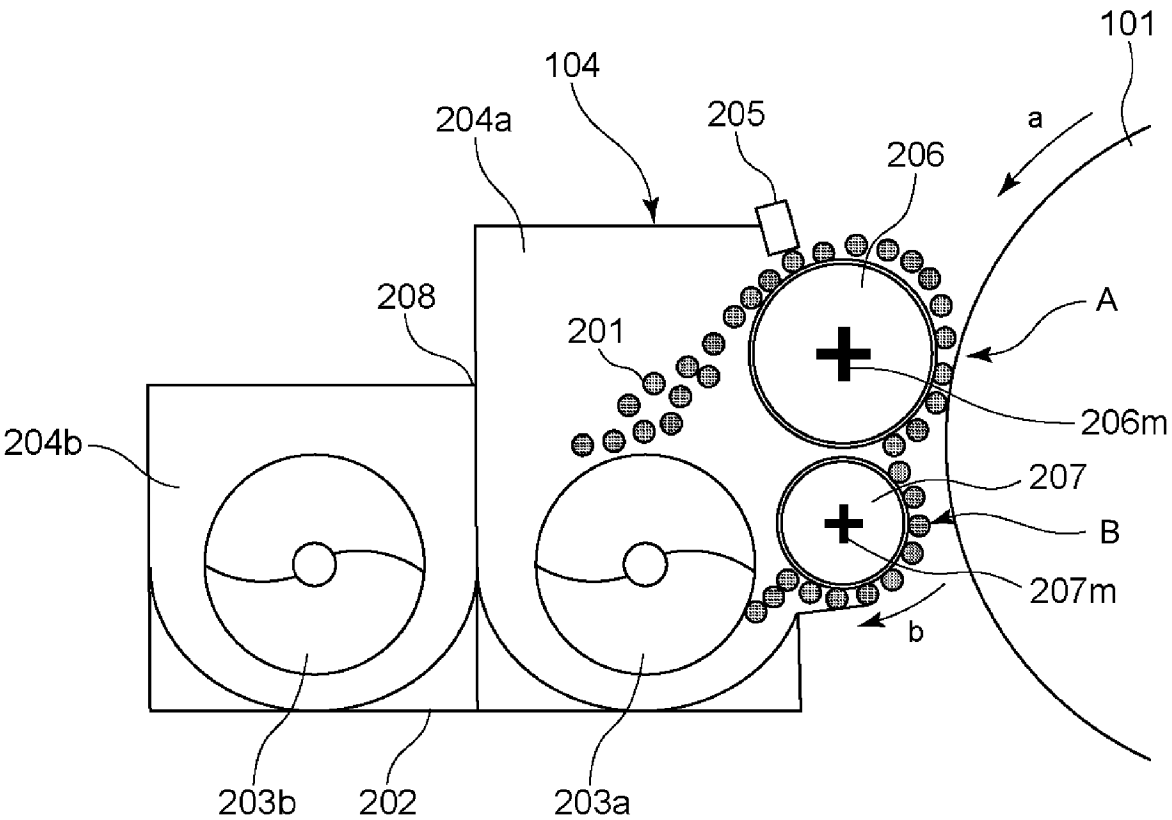
FIG. 11 is a schematic view (sectional view) of a developing apparatus according to Embodiment 3 of the present invention.
Figure 12:
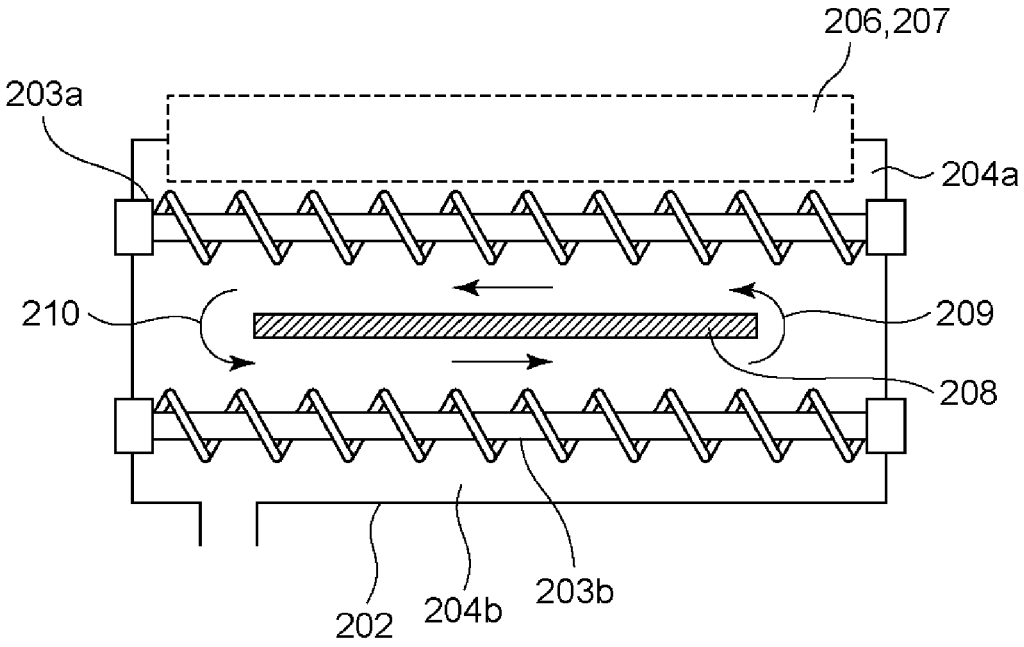
FIG. 12 is a schematic view (longitudinal) of the developing apparatus of Embodiment 3.

Referring to FIG. 11, the developing apparatus 104 will be described in detail. In this embodiment, the developing apparatus 104 comprises a developing container 202 in which developer 201 containing toner and carrier particles is accommodated. The apparatus comprises two developing sleeves as developer carrying means in the developing container 202, the developer is fed from an upstream developing sleeve 206 to a downstream developing sleeve 207 with respect to a feeding direction b. The developing apparatus further comprises a chain cutting member 205 for regulating the chains of the developer carried on the developing sleeve 206.

In this embodiment, the inside of the developing container 202 is divided, at substantially the central portion thereof, into left and right regions, that is, a developer chamber 204*a* and a stirring chamber 204*b* by a partition 208 extending in the direction perpendicular to the sheet of the drawing.

In the developer chamber 204*a* and the stirring chamber 204*b*, there are provided first and second feeding screws 203*a*, 203*b* which are feeding members as feeding means. The first feeding screw 203*a* extends substantially parallel with axial directions of the developing sleeves 206 and 207 at a bottom portion of the developer chamber 204*a*, and it feeds the developer in the developer chamber 204*a* along the axial direction in one direction by the rotation thereof. The second feeding screw 203*b* extends substantially parallel with the first feeding screw 203*a* at the bottom portion in the stirring chamber 204*b*, and it feeds the developer in the stirring chamber 204*b* in a direction opposite that of the first feeding screw 203*a*.

Thus, by the feeding operation by the rotation of the first and second feeding screws 203*a*, 203*b*, the developer is circulated between the developer chamber 204*a* and the stirring chamber 204*b* through the openings (communicating portions) 209, 210 of the opposite ends of the partition 208.

In this embodiment, the developer chamber 204*a* and the stirring chamber 204*b* are arranged horizontally, but this is not inevitable, and the developer chamber 204*a* and the stirring chamber 204*b* may be arranged vertically or in another direction.

In this embodiment, an opening is provided at a position of the developing container 202 corresponding to a developing zone An and a developing zone opposed to the photosensitive drum 101.

In this embodiment, a diameter of the upstream developing sleeve 206 is 24 mm, a diameter of the downstream developing sleeve 207 is 20 mm, a diameter of the photosensitive drum 101 is 80 mm, and a closest region between the developing sleeves 206 and 207 and the photosensitive drum 101 is approx. 400 μm. With such a structure, the developing operation is effected in the state that the developer fed to the developing zone A and the developing zone B are contacted to the photosensitive drum 101. The developing sleeves 206 and 207 are made of non-magnetic material such as aluminum or stainless steel, and magnet rollers 206*m* and 207*m* are non-rotatably provided therein, respectively. With such a structure, the developing sleeves 206 and 207 are rotated in the direction indicated by the arrow b as shown in FIG. 11 (clockwise direction) during development, the layer thickness of the developer is regulated by chain cutting of the magnetic brush by the chain cutting member 205 and is carried by the sleeves. The developing sleeves 206 and 207 feed the developer in the form of a thickness-regulated layer to the developing zone A facing the photosensitive drum 101 to supply the developer to the electrostatic latent image formed on the photosensitive drum 101 to develop the latent image. At this time, in order to enhance the development efficiency, that is, the application rate of the toner to the latent image, a developing bias voltage is applied similarly to Embodiment 1 and Embodiment 2.

A regulating blade 205 which is a chain cutting member is a plate-like member extending along the axes of the developing sleeves 206 and 207. The material of the regulating blade 205 is a non-magnetic material such as aluminum or stainless steel or the like or a magnetic low-carbon steel material such as SPCC or the like, or a composite plate including non-magnetic material and said magnetic material. The regulating blade 205 is disposed upstream of the photosensitive drum 101 with respect to the rotational moving direction of the developing sleeve. Both of the toner and the carrier of the developer passes through between the free end portion of the chain cutting member 205 and the developing sleeve 206 toward the developing zone A.

By adjusting the gap between the regulating blade 205 and the surface of the developing sleeve 206, the chain cutting amounts of the magnetic developer brushes carried on the developing sleeves 206 and 207 are regulated so that the amounts of the developer fed to the developing zone is adjusted. The gap between regulating blade 205 and the developing sleeve 206 is 200-1000 μm, preferably 300-700 μm. In this embodiment, it is 500 μm. In the developing zone A, the peripheral surfaces of the developing sleeves 206 and 207 of the developing apparatus 104 moves codirectionally with moving direction of the photosensitive drum 101, wherein a peripheral speed ratio relative to the photosensitive drum is 2.0. The peripheral speed ratio is 0-3.0 times, preferably 0.5-2.0 times. With increase of the moving speed ratio, the development efficiency increases, but if it is too large, another problem such as toner scattering or developer deterioration the may arise, and therefore, these ranges are preferable.

The structure relating to the supply of the developer is similar to that of the developing apparatus in Embodiments 1 and 2, and therefore, the description thereof is omitted for simplicity.

<Magnetic Pole Pattern of the Magnet Roller in Developing Sleeve and Feeding of Developer>

Figure 13:
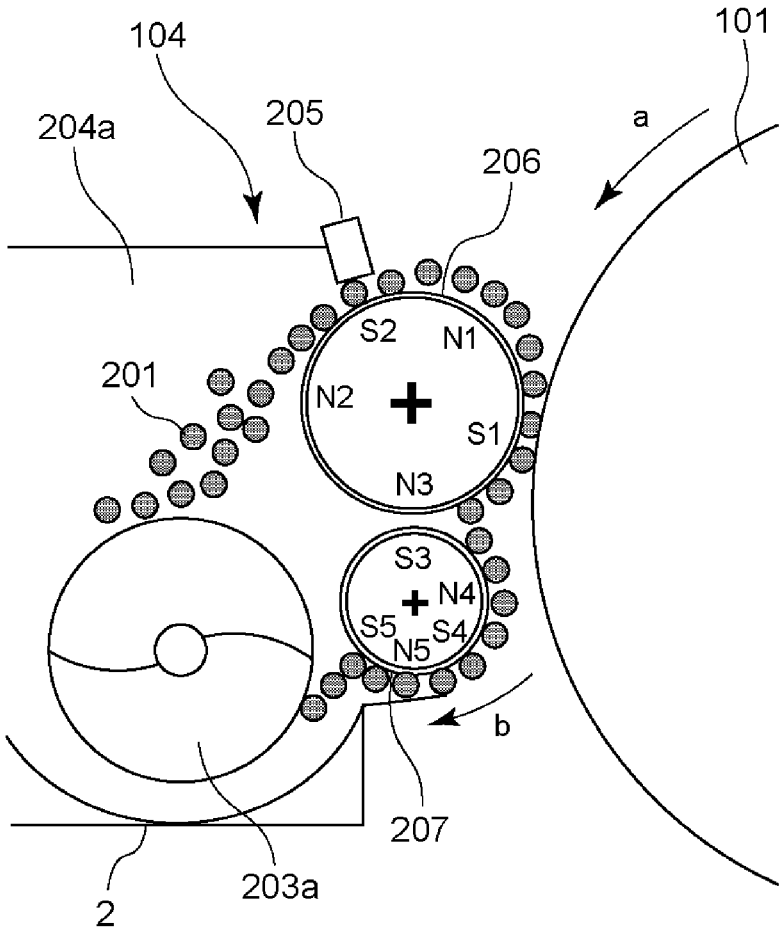
FIG. 13 is a schematic view around a developing sleeve of the developing apparatus of Embodiment 3.

Referring to FIG. 13, the detail of the magnet roller fixed non-rotatably in the developing sleeve and behavior of the developer fed on the developing sleeve in this embodiment will be described.

In the upstream developing sleeve 206, a first magnetic field generating means (magnet roller) 206*m* in the form of a roller is provided stationarily. The first magnet roller 206*m* has a developing magnetic pole S1 opposed to the first developing zone A. A magnetic brush of the developer is formed by the developing magnetic field formed in the first developing zone A by the developing magnetic pole S1, and the magnetic brush contacts the photosensitive drum 101 rotating in the direction of arrow An in the first developing zone to develop the electrostatic latent image in the first developing zone A. The first magnet roller 6*m* includes the developing magnetic pole S1, and four additional poles N1, N2, N3, S2, among which N2 pole and N3 pole have the same polarity and are adjacent to each other within the developer container 202 to form a barrier against the developer 201.

In addition, below the first developing sleeve 206, a second developer carrying member, that is, a second developing sleeve 207 is provided in a downstream side with respect to the rotational moving direction of the photosensitive drum 10, and the second developing sleeve 207 is rotatable in a direction of arrow b. The second developing sleeve 207 is substantially opposed to both of the first developing sleeve 206 and the photosensitive drum 101. The second developing sleeve 207 is made of a structure similarly to the first developing sleeve 206, and in the sleeve, a second magnet roller 207m as a second magnetic field generating means is non-rotatably provided. The second magnet roller 207*m* has five magnetic poles, namely magnetic poles S3, S4, S5, N4 and N5.

The developer 201 is fed and flipped up by the first feeding screw and is trapped by the N2 pole (scooping pole) of the first developing sleeve 206. With rotation of the developing sleeve 206, the developer is fed in the order of N2, S2 (cutting pole), N1 (feeding pole), S1 (developing pole), N3 (relaying pole). Thereafter, the developer on the first developing sleeve 206 moves to the second developing sleeve 207, and the developer is fed on the second developing sleeve 207 in the order of S3 (receiving pole), N4 (second), S4 (feeding pole), N5 (taking pole) and S5 (peeling pole). The S4 pole and the S5 pole are the same in the polarity and are adjacent to each other within the developer container 202 to form the barrier against the developer 201, and therefore, the developer is released from the magnetic confining force of the magnetic pole to return to the first feeding screw.

Among them, in the second developing zone B where the second developing sleeve 207 is opposed to the photosensitive drum 101, the pole N4 is contacted to the photosensitive drum 101, and the second developing operation is effected to the electrostatic latent image which has been developed in the first developing zone By effecting the second development, a further high development efficiency is accomplished.

As described hereinbefore, by using two developing sleeves, a high development efficiency is assured even if the developing time is reduced to meet the high speed of the peripheral speed of the photosensitive drum, so that the satisfactory image formation can be carried out without decrease of the developed image density or density non-uniformity.

<Structure of End Portion of Developing Apparatus>

Figure 14:
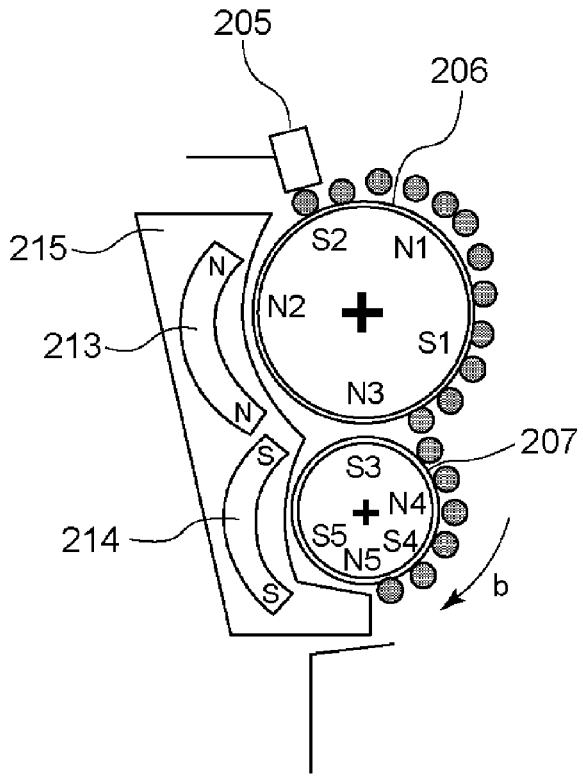
FIG. 14 is a schematic view around a developing sleeve of the developing apparatus of Embodiment 3.

Referring to FIG. 14, a structure of an end portion of the developing apparatus will be described. Also in this embodiment, similarly to Embodiments 1 and 2, a side having the same polarity of a magnetic pole opposed to magnet rollers 206*m* and 207*m* in the end magnets 213 and 214 is faced to the developing sleeve side. More particularly, to the N2 pole, N3 pole, S3 pole, S5 pole and N5 pole, the same polarity side of the end magnets 213 and 214 is faced to the developing sleeve side. The magnetization patterns are different between the sleeves so that the same polarity opposing arrangement is accomplished also for the N5 pole of the downstream developing sleeve 207. With such a structure, a gap is formed between the region of the developer retained by the end magnet and the region of the developer fed by the developing sleeve in the end portions of the upstream developing sleeve 206 and downstream developing sleeve 207. As a result, there is no shear plane, and therefore, the toner leakage can be prevented. To the region opposed to a pair of the magnetic poles of the same polarity of the magnetic poles of the magnet roller, the same polarities are opposed. By doing so, the magnetic seal is established to the repelling region between the magnetic poles of the same polarity, and the stationary layer does not appear.

In the region where the same polarity poles are not opposed, a magnetic end plate 215 in place of the magnet is provided covering the entire prepheries of the developing sleeves 206 and 207. The magnetic end plate 215 is disposed inside, with respect to longitudinal direction, the end magnets 213 and 214 in the range enclosed by thick lines.

In the developing apparatus of the this embodiment, the magnetic flux density of the end magnets 213 and 214 is 700 G and the gaps between the developing sleeves 206 and 207 are 650 μm, and the gaps, in the longitudinal direction, between the magnet rollers 206*m* and 207 are 2.0 mm. An inside end of the magnetic end plate 215 with respect to the longitudinal direction is substantially at the same position as the outer end of the magnet rollers 206*m* and 207*m*. However, such arrangements are not limiting. Depending on the conditions such as the magnetic flux density and/or material of the end magnet, the positional relation between the developing sleeve and the end magnet, the material of the magnetic end plate, the positional relation between the developing sleeve and the magnetic end plate or the like, they can be modified.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 2011-187326 filed Aug. 30, 2011 which is hereby incorporated by reference.

What is claimed is:

1. A developing apparatus comprising;

a developing container for accommodating developer including magnetic particles;

a developer carrying member, rotatably provided in said developing container, for carrying the developer to a region where said developer carrying member is opposed to an image bearing member;

a magnet, stationarily provided in said developer carrying member, having a pair of magnetic poles of the same polarity adjacent to each other in a circumferential direction of said developer carrying member; and a magnet seal member provided at each of opposite ends of said developer carrying member with respect to a longitudinal direction thereof, wherein said magnet seal member is extended along the circumferential direction of said developer carrying member in a region interposed between half-peak widths of said pair of magnetic poles and a region opposing the half-peak-widths, and wherein said magnet seal member has a surface opposing said developer carrying member, the surface being magnetized with only a polarity which is the same as the polarity of said pair of magnetic poles.

2. An apparatus according to claim 1, wherein said magnet seal member does not extend beyond the region interposed between half-peak-widths of said pair of magnetic poles and the region opposing half-peak-widths.

3. An apparatus according to claim 1, further comprising a magnetic seal member provided at each of opposite ends of said developer carrying member with respect to the longitudinal direction thereof, wherein said magnetic seal member extends along the circumferential direction of said developer carrying member at a position different from said magnet seal member with respect to the longitudinal direction of said developer carrying member, and wherein a magnetic brush confined by said magnetic seal member and a magnetic brush confined by said magnet seal member contact said developer carrying member in a space in the longitudinal direction of said developer carrying member.

4. An apparatus according to claim 3, wherein said magnetic seal member is disposed inside said magnetic seal member with respect to a longitudinal axis of said developer carrying member.

* * * * *